US010837612B2

(12) United States Patent
Papoular

(10) Patent No.: US 10,837,612 B2
(45) **Date of Patent: *Nov. 17, 2020**

(54) LUMINAIRES

(71) Applicant: SCHREDER S.A., Brussels (BE)

(72) Inventor: André Papoular, Waterloo (BE)

(73) Assignee: SCHREDER S.A., Brussels (BE)

( * ) Notice: Subject to any disclaimer, the term of this patent is extended or adjusted under 35 U.S.C. 154(b) by 0 days.

This patent is subject to a terminal disclaimer.

(21) Appl. No.: 16/435,247

(22) Filed: Jun. 7, 2019

(65) Prior Publication Data

US 2019/0376656 A1 Dec. 12, 2019

Related U.S. Application Data

(63) Continuation of application No. 15/578,660, filed as application No. PCT/EP2016/062654 on Jun. 3, 2016, now Pat. No. 10,317,029.

(30) Foreign Application Priority Data

Jun. 5, 2015 (BE) ..... 2015/5349

(51) Int. Cl.
*F21S 9/03* (2006.01)
*F21S 8/08* (2006.01)
(Continued)

(52) U.S. Cl.
CPC ..... *F21S 9/035* (2013.01); *F21S 8/08* (2013.01); *F21S 8/088* (2013.01); *F21S 9/043* (2013.01);
(Continued)

(58) Field of Classification Search
CPC .... F21S 9/035; F21S 8/08; F21S 8/088; F21S 9/043; F21V 21/30; F21V 23/0442;
(Continued)

(56) References Cited

U.S. PATENT DOCUMENTS 9,007,225 B2 4/2015 Kates
9,976,734 B2 5/2018 Galloppa et al.
(Continued)

FOREIGN PATENT DOCUMENTS

EP 1623154 B1 2/2006
KR 10-2008-0068454 A 7/2008
(Continued)

OTHER PUBLICATIONS

Communication pursuant to Article 94(3) EPC dated Jul. 22, 2019, Issued in European Application No. 16728894.3, 6 pages.
(Continued)

*Primary Examiner* — Kerri L McNally
(74) *Attorney, Agent, or Firm* — Christensen O'Connor Johnson Kindness, PLLC

(57) ABSTRACT

A system for a luminaire comprising a lighting unit connected to a luminaire power supply. A controller is provided for controlling the operation of a communication unit and a signaling unit in accordance with environmental parameters sensed by a sensor unit, the sensor unit generating an event signal when the environmental parameters exceed a predetermined threshold and a signaling unit providing an alarm.

23 Claims, 4 Drawing Sheets

(51) Int. Cl.

| | |
|---|---|
| ***F21V 23/04*** | (2006.01) |
| ***G08B 3/10*** | (2006.01) |
| ***G08B 5/36*** | (2006.01) |
| ***G08B 25/08*** | (2006.01) |
| ***H05B 47/19*** | (2020.01) |
| ***F21S 9/04*** | (2006.01) |
| ***F21V 21/30*** | (2006.01) |
| ***G08B 27/00*** | (2006.01) |
| *F21W 131/103* | (2006.01) |
| *F21V 33/00* | (2006.01) |
| *F21Y 115/10* | (2016.01) |
| *F21Y 113/13* | (2016.01) |
| *F21Y 113/17* | (2016.01) |

(52) U.S. Cl.
CPC ..... *F21V 21/30* (2013.01); *F21V 23/0442* (2013.01); *G08B 3/10* (2013.01); *G08B 5/36* (2013.01); *G08B 25/08* (2013.01); *G08B 27/005* (2013.01); *H05B 47/19* (2020.01); *F21V 23/0435* (2013.01); *F21V 33/0076* (2013.01); *F21W 2131/103* (2013.01); *F21Y 2113/13* (2016.08); *F21Y 2113/17* (2016.08); *F21Y 2115/10* (2016.08)

(58) Field of Classification Search
CPC . G08B 3/10; G08B 5/36; G08B 25/08; G08B 27/005; H05B 37/0272
USPC ..... 340/815.4
See application file for complete search history.

(56) References Cited

U.S. PATENT DOCUMENTS

| | | | | |
|---|---|---|---|---|
| 10,317,029 | B2 * | 6/2019 | Papoular | H05B 37/0272 |
| 2002/0070929 | A1 * | 6/2002 | Hunter | G08B 7/06 345/204 |
| 2010/0029268 | A1 * | 2/2010 | Myer | F21S 2/00 455/426.1 |
| 2012/0147604 | A1 * | 6/2012 | Farmer | H05B 37/0254 362/249.03 |
| 2013/0032773 | A1 * | 2/2013 | Jette | E01F 13/028 256/65.02 |
| 2014/0139116 | A1 | 5/2014 | Reed | |
| 2014/0211487 | A1 | 7/2014 | Spiro | |
| 2014/0026587 | A1 | 9/2014 | Marquardt et al. | |
| 2015/0002305 | A1 * | 1/2015 | Wells | H05B 37/0272 340/815.4 |

FOREIGN PATENT DOCUMENTS

| | | | |
|---|---|---|---|
| KR | 10-2011-0041886 | A | 4/2011 |
| WO | 2015/183925 | B1 | 12/2015 |

OTHER PUBLICATIONS

International Search Report dated Aug. 22, 2016 for International Application No. PCT/EP2016/062654, filed Jun. 3, 2016, 3 pages.
Written Opinion dated Aug. 22, 2016, from the International Searching Authority for International Application No. PCT/EP2016/062654, filed Jun. 3, 2016, 7 pages.
International Preliminary Report on Patentability and Written Opinion dated Dec. 5, 2017, issued in corresponding International Application No. PCT/EP2016/062654, filed Jun. 3, 2016, 8 pages.
Examination Report dated Jun. 24, 2020, issued in corresponding Indian Application No. 201717044860, filed Dec. 13, 2017, 6 pages.
Communication Pursuant to Article 94(3) EPC, dated Aug. 10, 2020, issued in related EP Application No. 16 728 894.3, filed Jun. 3, 2016, 6 pages.

* cited by examiner

LUMINAIRES

CROSS-REFERENCES TO RELATED APPLICATIONS

This application is a continuation of U.S. patent application Ser. No. 15/578,660, filed Nov. 30, 2017, which is the National Stage of International Application No. PCT/EP2016/062654, filed Jun. 3, 2016, which claims priority to Belgian Application No. 2015/5349, filed Jun. 5, 2015, all the disclosures of which are incorporated by reference herein.

FIELD OF DISCLOSURE

Embodiments of the present disclosure relate to improvements in or relating to luminaires, and are more particularly concerned with providing additional functionality for luminaires.

BACKGROUND

Luminaires are well-known for providing lighting for an area in which the luminaire is positioned. Such a luminaire effectively comprises a modular luminaire assembly in which at least one module may be mounted coaxially on the supporting pole.

EP-B-1623154 discloses a lighting fixture which comprises at least one lighting module mounted on a supporting pole. The lighting pole defines an axis about which each lighting module can be rotatable with respect to an adjacent lighting module so that light can be directed in different directions around the axis.

Whilst the lighting fixture described in EP-B-1623154 allows the rotation of lighting modules with respect to an adjacent lighting module, there is no provision for the indication of environmental parameters in the vicinity of the lighting fixture or for signaling of the presence of an emergency.

US-A-2015/0002305 discloses a municipal infrastructure having the ability to centralize multiple services in one physical element thereof so that the infrastructure supports migration to other services as the infrastructure elements are renewed.

Whilst such an infrastructure provides the flexibility, additional functionality is added separately to the physical elements and is not incorporated into a modular luminaire structure where each module can be replaced and renewed independently of other modules forming the modular luminaire structure.

SUMMARY

It is an object of the present disclosure to provide a modular luminaire which has additional functionality indicative of environmental parameters, each modular luminaire having modules having both lighting and non-lighting functionality.

It is another object of the present disclosure to provide a system for monitoring environmental parameters and for generating alarms or alerts when the monitored environmental parameters exceed predetermined thresholds.

In accordance with one aspect of the present disclosure, there is provided a modular luminaire comprising:

at least one lighting module configured for providing lighting to a locality in which the luminaire is located;

at least one non-lighting module configured for providing non-lighting functionality;

at least one controller for controlling each lighting module and each non-lighting module; and a supporting pole configured for supporting the at least one lighting module and the at least one non-lighting module mounted thereon, each lighting module and non-lighting module forming part of the supporting pole when mounted thereon and connected to at least one of: an adjacent lighting module, an adjacent non-lighting module and the supporting pole;

wherein at least one non-lighting module comprises at least one sensor unit operable for sensing environmental parameters in the locality of the luminaire and for generating at least one event signal in response to the sensing of an abnormal occurrence, each event signal being transmitted to the at least one controller.

By incorporating non-lighting modules into a luminaire comprising a plurality of modules, it is possible to provide functionality which is in addition to lighting functionality. This has the advantage that event signals can be used to control other elements within the luminaire.

Moreover, modular luminaires have the advantage that they can be readily upgraded in accordance with the required functionality. In particular, each module can be replaced according to the required functionality of the luminaire, for example, lighting modules can be replaced with different lighting modules and the non-lighting modules can be replaced with either additional lighting modules or different non-lighting modules.

Preferably, each sensor unit generates the event signal in response to the sensing of an abnormal occurrence when a sensed environmental parameter is above a predetermined threshold.

Each sensor unit may be used for monitoring different environmental parameters, and as a consequence, may be configured accordingly.

In one embodiment, the at least one sensor unit comprises an air quality detector. In another embodiment, the at least one sensor unit comprises a smoke detector. In a further embodiment, the at least one sensor unit comprises a fire detector. In addition, the at least one sensor unit may comprise an acoustic detector, a seismic detector and/or a radiation detector.

It will be appreciated that more than one sensor unit may be provided, each sensor unit being a different type of detector.

Advantageously, the at least one non-lighting module further comprises a signaling unit configured for receiving at least one event control signal from the at least one controller in accordance with a sensed abnormal occurrence and for generating at least one alarm.

In one embodiment, the signaling unit may comprise a multi-colored light-emitting diode ring, the colors of which are controlled in accordance with the at least one event control signal to generate an alarm.

In this embodiment, the multi-colored light-emitting diode ring may form a module of the luminaire. In this way, elements may be distributed throughout different modules of the luminaire in accordance with their functionality.

In another embodiment, the signaling unit may comprise a loudspeaker which is controlled by the at least one event control signal to generate an alarm. The loudspeaker may be in addition to or instead of the multi-colored light-emitting diode ring.

The loudspeaker may operate as a siren to generate the alarm. In addition or alternatively, the loudspeaker may operate to relay a spoken message as the alarm. The spoken message may comprise a pre-recorded message, or alternatively, the spoken message may comprise a live message.

In a simple embodiment, the signaling unit may comprise a display which displays information relating to the abnormal occurrence. The display may be mounted on the luminaire or on a supporting pole on which the luminaire is mounted.

In another embodiment, the at least one event control signal from the at least one controller in accordance with a sensed abnormal occurrence may be operable for adjusting the operation of the at least one lighting module to provide flashing light. In this embodiment, the flashing light provides an alert or alarm and the frequency of the flashing may be adjusted so that it is clearly recognisable as an alert or alarm.

The at least one non-lighting module may comprise at least one communication unit configured for connecting to a local area network and for transmitting signals thereto and receiving signals therefrom.

The communication unit may operate using Bluetooth protocol, Wi-Fi protocol and/or ZigBee protocol.

In one embodiment, the communication unit comprises means for linking to an internet connection.

In such an embodiment, the communication unit may operate to provide an event control signal to a remote location via the internet connection in response to an event signal generated by the at least one sensor unit.

In accordance with another aspect of the present disclosure, there is provided a luminaire network comprising a plurality of modular luminaires as described above.

By providing a luminaire network, functionality can be split so that not all modular (or even non-modular) luminaires in the network are required to perform the sensing and/or the signaling of an abnormal occurrence.

In one embodiment, the luminaire network further comprises an internet connection to which at least one of the plurality of modular luminaires is connected.

Preferably, the luminaire network comprises a local area network to which the plurality of modular luminaires is connected. Such a local area network may operate using Bluetooth, Wi-Fi and/or ZigBee protocol.

In one embodiment, the at least one event signal is operable for providing event control signals for at least other modular luminaires in the network at least over the local area network. In another embodiment, the at least one event signal may provide event control signals for at least other modular luminaires in the network at least over the internet connection. In a further embodiment, the at least one event signal may provide event control signals to a remote location over the internet connection.

Ideally, in a luminaire network, the modular luminaires form a local area network and non-lighting functionality may be provided in at least one modular luminaire and event signals generated from at least one sensor unit in such a luminaire are used to control other luminaires (both modular and non-modular) in the network, and, at least one modular luminaire is connected to the internet so that event signals may be transmitted to other locations, for example, to a remote monitoring station.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Figure 1:
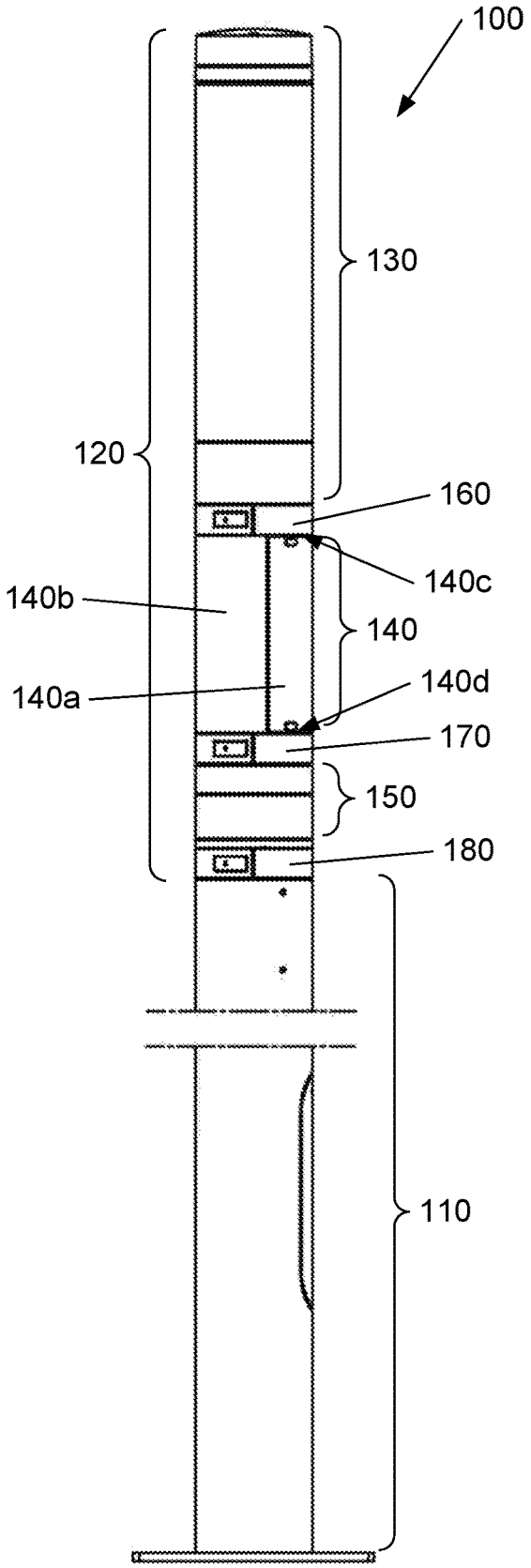
FIG. 1 illustrates a side view of a luminaire assembly in accordance with the present disclosure.

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

In accordance with the present disclosure, a luminaire comprising a plurality of modules is described which can be used to monitor environmental parameters in urban environments where luminaires are typically located for providing outdoor and street lighting. Such a luminaire is hereinafter referred to by the term "modular luminaire". Preferably, a plurality of modular luminaires is connected to a local area network (LAN) and each modular luminaire can communicate with at least other modular luminaires in the LAN. Each modular luminaire may also communicate with remote locations using an internet or 'cloud' connection. It will be appreciated that the LAN is not limited only to having modular luminaires but other non-modular luminaires may also be present and connected to the same LAN as modular luminaires.

Such environmental parameters may relate to atmospheric or emergency situations and for which alerts need to be provided in accordance with abnormal occurrences determined by the monitoring of such environmental parameters. In effect, by having a plurality of modular luminaires which have the functionality of monitoring such environmental parameters and for providing indication of abnormal occurrences within the environment, it may be possible to create a city dashboard which provides information for city authorities so that necessary actions can be taken in response to such abnormal occurrences, either on a short term or a long term basis depending on the occurrence and the ramifications of such an occurrence.

Additionally, with modular luminaires of the present disclosure, it is possible to provide people within the vicinity with an immediate message signaling the occurrence of an abnormal or an emergency situation. Such a message may be displayed on a display or screen mounted on at least one luminaire (or on a supporting pole on which the luminaire is mounted) or broadcast over a loudspeaker. Other representations of the message, for example, colored and/or flashing lights, may be also provided which operate alone or in combination with one another. In addition, signaling may be used to direct people in the vicinity towards safer areas of the neighborhood or of the city.

By using outdoor luminaires which are already strategically positioned all over the city, such luminaires may become ideal candidates for providing other functionality in addition to providing lighting. The combined functionality may be implemented in modular luminaires where lighting functionality is combined with non-lighting functionality, such as, sensing environmental parameters as will be described in more detail below.

It will be appreciated that the provision of modular luminaires provides a degree of flexibility for future improvements and/or functionality as modules can be added and/or replaced to update the overall functionality of the modular luminaire.

The term "flashing" as used herein refers to any interruption of normal operation of a lighting unit of a luminaire irrespective of its frequency and/or duty cycle. Flashing can be used as an emergency or alarm signal as will be described in more detail below.

FIG. 1 illustrates a luminaire 100 comprising a supporting pole 110 on which is mounted a plurality of modules 120, each module comprising a casing and effectively forming part of the supporting pole 110. In the illustrated embodiment, the plurality of modules comprises a first luminaire module 130, a second luminaire module 140, and a third luminaire module 150 which are connected to one another by module connectors 160, 170 and to the supporting pole 110 by module connector 180. Module connector 160 connects the first module 130 and the second module 140; module connector 170 connects the second module 140 and the third module 150; and module connector 180 connects the third module 150 to the supporting pole 110 as shown. The module connectors 160, 170, 180 provide a simple way of joining adjacent luminaire modules together and to the supporting pole 110 as described in Belgian patent application no. 2015/5217 and will not be described in detail here.

Each luminaire module 130, 140, 150 preferably comprises passageways (not shown) through which cabling can pass to adjacent modules, for example, coaxial cables could be threaded through the passageways luminaire modules with dedicated connections being made for each luminaire module, as it is expensive to form such connections at the level of each luminaire module, and, which may create a loss in signal thereat. In addition, each luminaire module may have one or more electrical connectors for providing electrical connections between modules (not shown).

Figure 2:
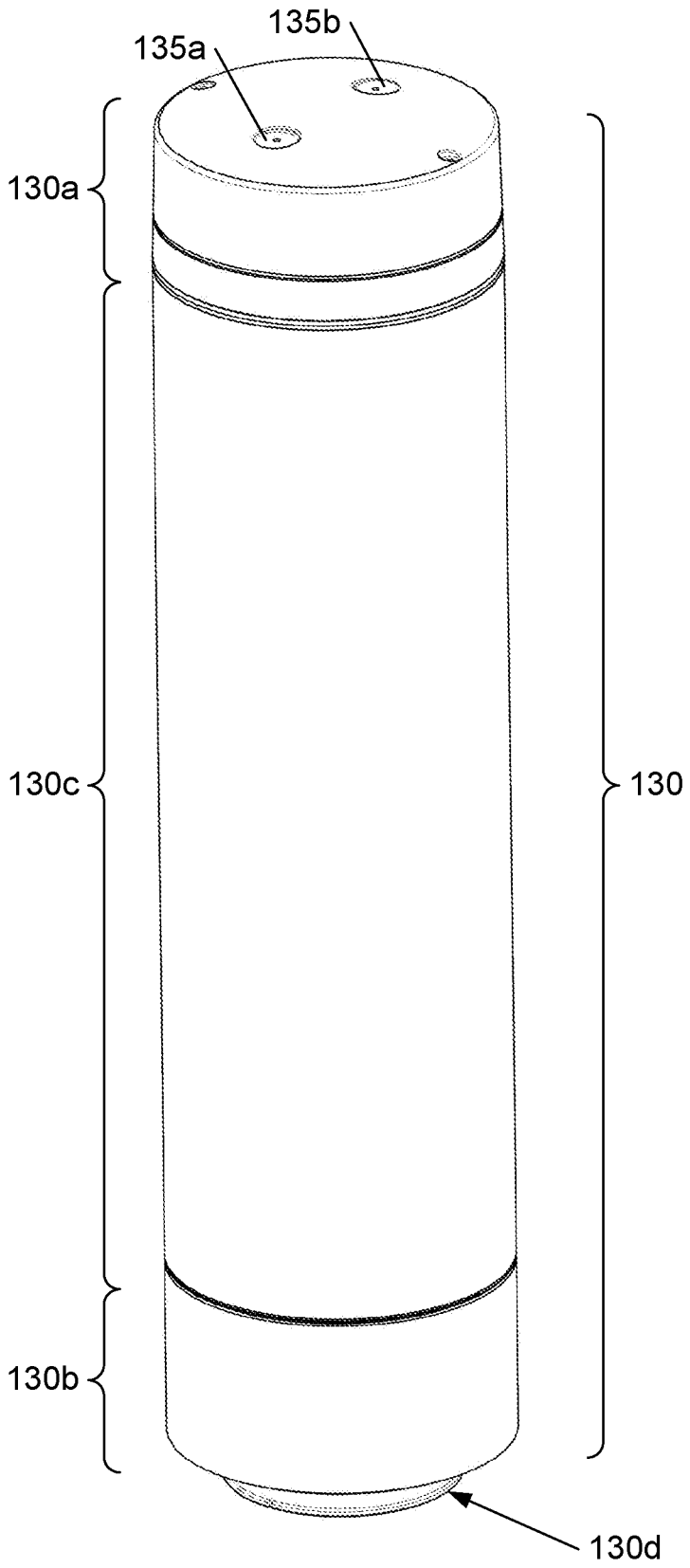
FIG. 2 illustrates a perspective view of a module forming an upper part of the luminaire assembly shown in FIG. 1.

Module 130 is shown in more detail in FIG. 2. This module forms the uppermost module of the modular luminaire assembly 100, as shown in FIG. 1, as it is the lightest. Module 130 is substantially circular in cross-section and comprises a first (or top or upper) portion 130*a*, a second (or bottom or lower) portion 130*b* which is connectable to another module using a module connector in accordance with the present disclosure as will be described in more detail below, and a third (or central) portion 130*c* between the first and second portions 130*a*, 130*b*. The second portion 130*b* includes a connector portion 130*d* which is connectable to a corresponding connector portion in another module as will be described in more detail below. The central portion 130*c* may comprise a casing made of a lightweight transparent polymeric material, for example, polycarbonate, and may include a light-emitting diode (LED) array (not shown) for providing light which can be transmitted through the transparent polymeric casing.

In other embodiments, the polymeric material from which the casing is made may be opaque or transparent, and may also include non-lighting related functions (also not shown), for example, a Wi-Fi transceiver module, a loudspeaker module, one or more camera modules, a video surveillance module, etc. In addition, the material from which the casing is made is not limited to polymeric materials and may comprise any other suitable lightweight and inexpensive material.

In one embodiment, each luminaire module has an external profile which matches the external profile of other luminaire modules so that the luminaire modules, when assembled on top of one another, define a substantially constant external profile for the modular luminaire.

The first portion 130*a* may include apertures 135*a*, 135*b* for antennas in accordance with particular use for each modular luminaire assembly. Such antennas are connected to coaxial cabling extending through passageways provided in the supporting pole 110 and in other luminaire modules as described above.

As described above, the second portion 130*b* includes a connector portion or interface 130*d* which engages a complementary connector portion or interface (not shown) provided in module 140 as will be described in more detail below, and which is held together by module connector 160.

Module 140 comprises a casing having a substantially circular cross-section but which is divided into a first part 140*a* made of a transparent polymeric material, such as polycarbonate, and a second part 140*b* made of a metallic material, such as aluminium. By having such a division in the casing, light can be directed in a predetermined direction as defined by the angle subtended by the first portion 140*a*. In this case, the module 140 may include an LED array (not shown) which provides light for transmission by the first part 140*b*. As mentioned above, the transparent polymeric material is intended to have particular properties.

A module similar to module 140, that is, having a transparent or opaque portion and a solid portion, may also comprise both lighting and non-lighting functionality.

For non-lighting functions, the polymeric material of which the casing is made may be opaque or non-transparent. In addition, the material from which the casing is made is not limited to polymeric materials and may comprise any other suitable lightweight and inexpensive material.

As shown in FIG. 1 (and FIGS. 4 and 5 described below), the casing of each luminaire, when assembled, has an external profile which substantially matches the casing of other luminaire modules and module connectors between adjacent luminaire modules.

Connector portions or interfaces (not shown) are provided at a first (or top or upper) end 140*c* and at a second (or bottom or lower) end 140*d*. The complementary connector portions or interfaces are held together by module connector 170. Such module connectors also have the same external profile of the casing of the luminaire modules so as to form a substantially uniform external profile for the modular luminaire.

Module 150 may comprise a casing having a substantially circular cross-section in which one or more LED arrays may be provided. Such LED arrays may comprise a single array having LED elements of only one color, a single array having LED elements of more than one color, for example, RGB (red/green/blue), which can be switched in one or more predetermined patterns to provide visual effects or for signaling purposes as will be described in more detail below with reference to FIG. 3. However, it will readily be appreciated that the colored LED elements are not limited to RGB and other colors may be used either by providing an appropriately colored LED or by mixing the light from the colored LED elements. In this case, the casing may comprise a transparent or semi-transparent material polymeric material through which the light from the LED elements can be transmitted.

Module 150 is mounted to the supporting pole 110 by way of a connector portion or an interface formed at a lower end (or bottom end), as shown in FIG. 1, of the module and a complementary connector portion or interface formed at an upper end (or top end) of the supporting pole 110. The complementary connector portions or interfaces are held together by module connector 180.

It will readily be appreciated that a module having non-lighting functionality may simply comprise an empty module forming part of the modular luminaire so that each modular luminaire has substantially the same dimensions. Such an empty module can be replaced, as required, with one of: a lighting module having lighting functionality; a non-lighting module with non-lighting functionality; and a module having a combination of both lighting and non-lighting functionality.

Although three luminaire modules and three module connectors are shown in FIG. 1, it will readily be appreciated that any appropriate number of luminaire modules may be mounted on the supporting pole and connected to one another and to the supporting pole by a corresponding number of module connectors. In addition, each module connector 160, 170, 180 may be interchangeable and may be the same irrespective of the luminaire modules to be connected together.

It is to be noted that each luminaire module may form a support for at least the luminaire module mounted above it on the supporting pole 110.

In accordance with the present disclosure, at least one luminaire module has a functionality which is unrelated to the provision of lighting or may have a combination of the lighting and non-lighting functionalities as described above. An example of such a functionality is described below with reference to FIG. 3.

Figure 3:
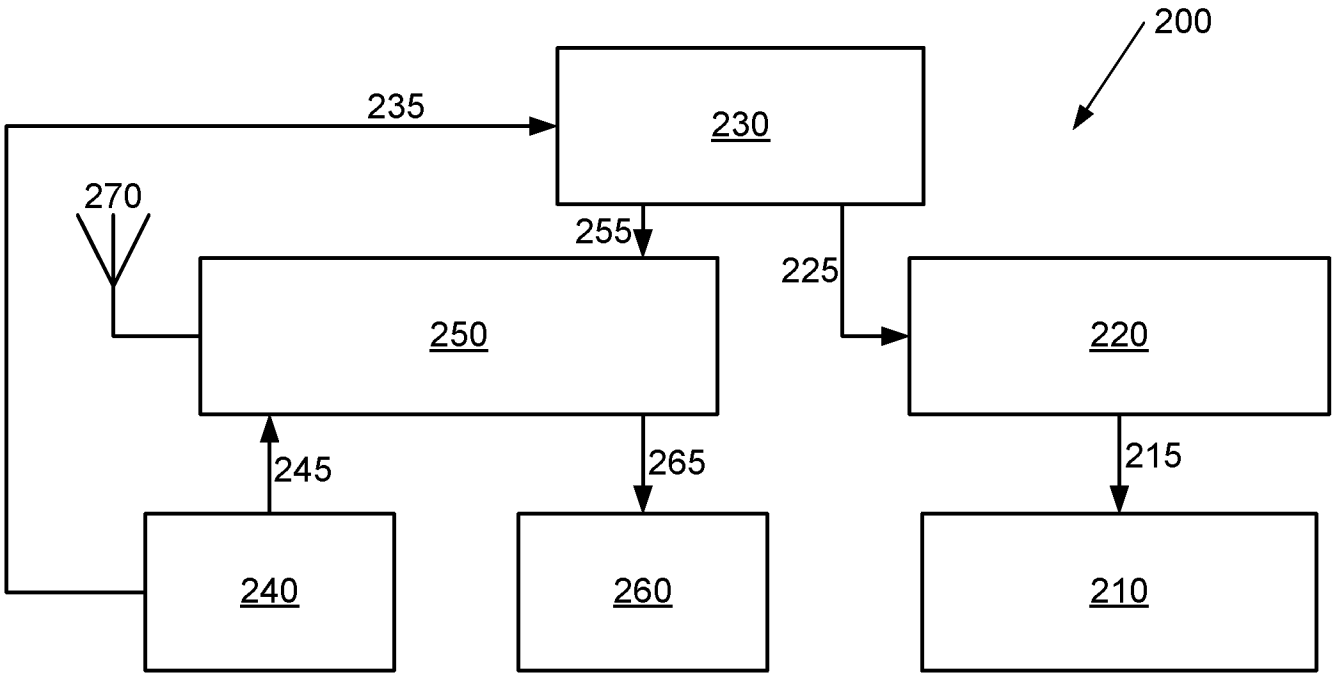
FIG. 3 illustrates a block diagram of control elements within the luminaire assembly.

FIG. 3 illustrates one embodiment of a system 200 in accordance with the present disclosure, which is fully integrated with a luminaire controller (not shown) for providing additional non-lighting functionality. The system 200 may be located in one of the luminaire modules as described above with reference to FIGS. 1 and 2 or may be distributed over more than one luminaire module in accordance with the non-lighting functionality.

As described above, luminaire module 130 may provide a lighting functionality where light sources are provided for illuminating a street or a building; luminaire module 140 may provide non-lighting functionality, for example, sensing or detection of environmental parameters; and luminaire module 150 may be dedicated to signaling, for example, providing audio and/or visual alarms, in response to abnormal occurrences sensed by components within luminaire module 140.

The system 200 comprises a lighting unit 210, a luminaire power supply 220, a controller 230, a sensor unit 240, a communication unit 250, and a signaling unit 260.

As shown in FIG. 3, the lighting unit 210 is connected to the luminaire power supply 220 and receives control signals 215 therefrom. It will readily be appreciated that the lighting unit 210 and associated luminaire power supply 220 may be located in the luminaire module 130 as described above and may also operate in accordance with convention lighting functionality.

The luminaire power supply 220 is connected to the controller 230 and receives control signals 225 therefrom. The controller 230 is also connected to the sensor unit 240 and receives signals 235 therefrom which are indicative of events sensed by the sensor unit 240. The sensor unit 240 is also connected to the communication unit 250 and provides signals 245 indicative of events sensed thereby. Communication unit 250 is connected to the controller 230 and to the signaling unit 260, and receives control signals 255 from the controller 230 and provides control signals 265 for the signaling unit 260.

In one embodiment, the sensor unit 240 may operate in conjunction with a remote sensor device located outside the luminaire to provide signals indicative of events sensed by one of or both the sensor unit and the remote sensor device.

The controller 230 may be located in a suitable location within the luminaire 100, for example, in any one of the modules 130, 140, 150, as described above.

In another embodiment, the communication unit 250 and the controller 230 may comprise a single unit. In this case, only sensor signals 245 are needed and control signals 255 from the controller are no longer needed as these control signals are effectively internal signals within the communication unit 250. Similarly, control signals 225 would be provided from the communication unit 250 to the luminaire power supply 220 (or from the part of the communication unit designated as the controller).

In a further embodiment, the controller 230 may be integrated with the luminaire power supply 220 to form a single unit with appropriate connections being made to the communication unit 250 for control thereof and with the sensor unit 240 providing signals indicative of events sensed thereby.

The communication unit 250 is preferably connected to other modular luminaires (and also to non-modular luminaires) in the vicinity by either a wired link or a wireless link. In this case, the communication unit 250 may also include one or more antennas 270 and operates to send information indicative of an event to adjacent modular luminaires and to receive information indicative of an event from one or more adjacent modular luminaires. Antennas 270 may also provide connection to the LAN or to the internet for remote control and monitoring. Antennas 270 may be associated with apertures 135*a*, 135*b* formed in portion 130*a* of module 130 as described above with reference to FIG. 2.

Moreover, each communication unit 250 may provide signals for a control room or monitoring station indicating the status of environmental parameters in the vicinity of the luminaire with which it is associated in accordance with sensor information. Such signals may be used to dispatch emergency vehicles if required, and/or may be used to indicate that a live message is required providing appropriate advice for people in the vicinity of the luminaire in accordance with the abnormal occurrence.

In one embodiment, the communication unit 250 is connected to adjacent modular luminaires (or other non-modular luminaires) in a LAN using wireless protocols, for example, Bluetooth, ZigBee and Wi-Fi. [Bluetooth is a trademark of the Bluetooth Special Interest Group (SIG) and is a wireless technology standard for exchanging data over short distances. ZigBee is a trademark of the ZigBee alliance and is based on the IEEE 802.15.4 standard. Wi-Fi (or WiFi) is a brand name for products using IEEE 802.11 standards.]

It will readily be appreciated that the communication unit may not be limited to one protocol and may be configured to operate using more than one of the protocols described above. In addition, the communication unit may be configured for linking with an internet connection so that event signals can be transferred to remote locations, for example, to a remote monitoring station.

The sensor unit 240 may comprise a plurality of sensor elements (not shown) for sensing and/or detecting occurrences in the vicinity of the luminaire (also not shown) in which the system 200 is located. Each sensor element may be chosen in accordance with particular environmental parameters to be sensed and/or detected. For example, there may be sensor elements which sense air quality, the presence of smoke, the presence of toxic fumes, the presence of fire, the presence of unusual radiation levels etc., and provide appropriate alarm(s) as will be described in more detail below.

Air quality sensor elements may be used to sense air pollution levels and to provide signals indicating that the sensed air pollution level is above a predetermined threshold level as will be described in more detail below. Similarly, smoke detectors or smoke sensor elements may provide signals indicating that a predetermined threshold has been exceeded. It will readily be appreciated that an air quality sensor element may also perform the function of a smoke detector or smoke sensor element. Air quality sensor elements may also be operable for the detection of toxic fumes, for example, from a chemical spill or a chemical fire. Alternatively, separate chemical sensors may be provided in luminaires positioned in areas of high risk.

In addition, there may be one or more acoustic sensor elements which detect abnormal occurrences, such as, gunshots, and, based on the analysis of the detected or sensed sound by the controller 230, generate an alarm at a police station whilst signaling that there is danger in the vicinity.

Seismic sensors may be incorporated in the system 200 for luminaires in areas susceptible to seismic or volcanic activity. Such seismic sensors may generate signals indicating an imminent earthquake or eruption if a predetermined threshold has been exceeded. As described above, the signals so generated are used to trigger alarm(s) indicative of the seismic or volcanic activity thereby providing an early warning so such activity.

Radiation detectors, for example, Geiger counters, dosimeters, or other detectors capable of detecting the presence of ionizing radiation, may be incorporated in the system 200 for luminaires in the locality of nuclear reactors.

In one embodiment of the present disclosure, the sensor unit 240 may comprise a simple "Emergency" push button which triggers an alarm locally, for example, sending an appropriate signal to the signaling unit 260, and/or at a remote location, such as, a police station, via an internet connection. Signals may also be provided to other luminaires in the vicinity, via the LAN, so that they can also indicate that there is an abnormal occurrence or an emergency.

The signaling unit 260 operates to provide alarm signals to people in the vicinity of a luminaire when an abnormal occurrence or event occurs. The signaling unit 260 may be located in luminaire module 150 as described above, and may comprise a multi-colored LED ring which, when activated, may display a single color, the single color being controlled to flash at one or more frequencies to indicate the occurrence of a particular abnormal event. Changes in color and flashing frequency may also be used, for example, a change in color of the LED ring may be used to indicate air quality levels as sensed by an air quality sensor element as described above, and flashing of one or more colors may indicate an emergency situation.

The signaling unit 260 may also comprise a loudspeaker which may operate as a siren or provide a spoken message in response to a control signal from the communication unit 250. The spoken message may be pre-recorded or may be a live message.

It will be appreciated that the system in accordance with the present disclosure is not limited to having only one method of signaling an emergency or alarm, for example, a combination of a spoken message together with flashing lighting modules and/or changes in colors of the LED ring may be used.

Figure 4:
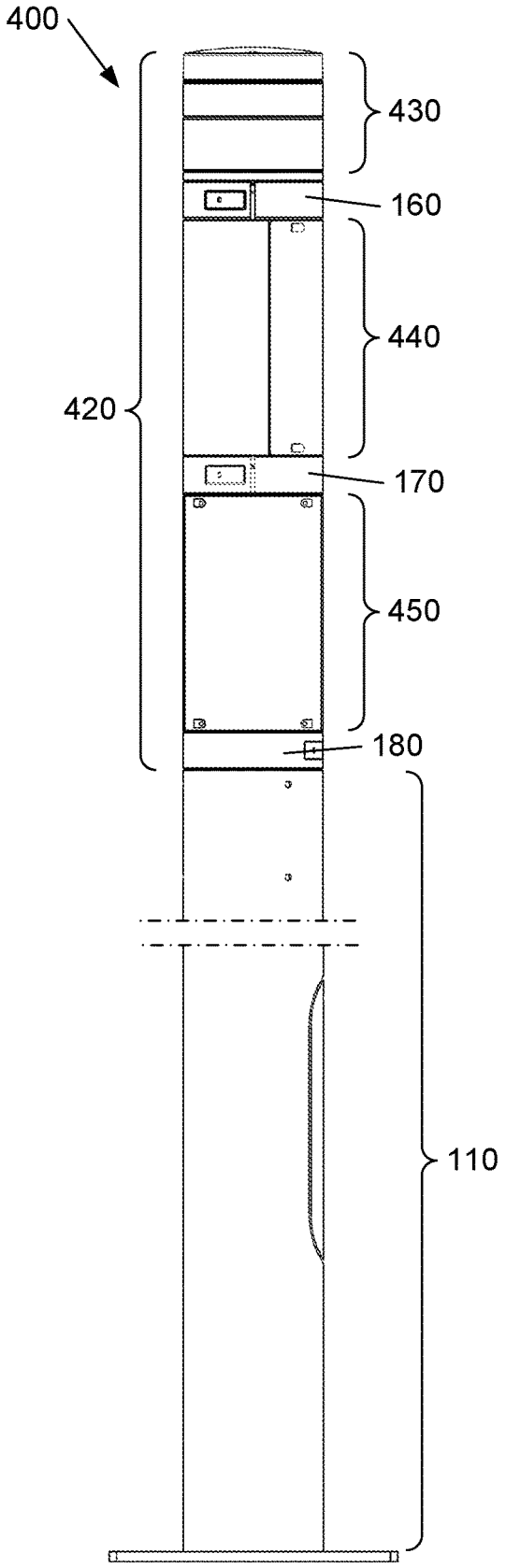
FIGS. 4 and 5 are similar to FIG. 1 but respectively illustrating different modular luminaire assemblies in accordance with the present disclosure.
Figure 5:
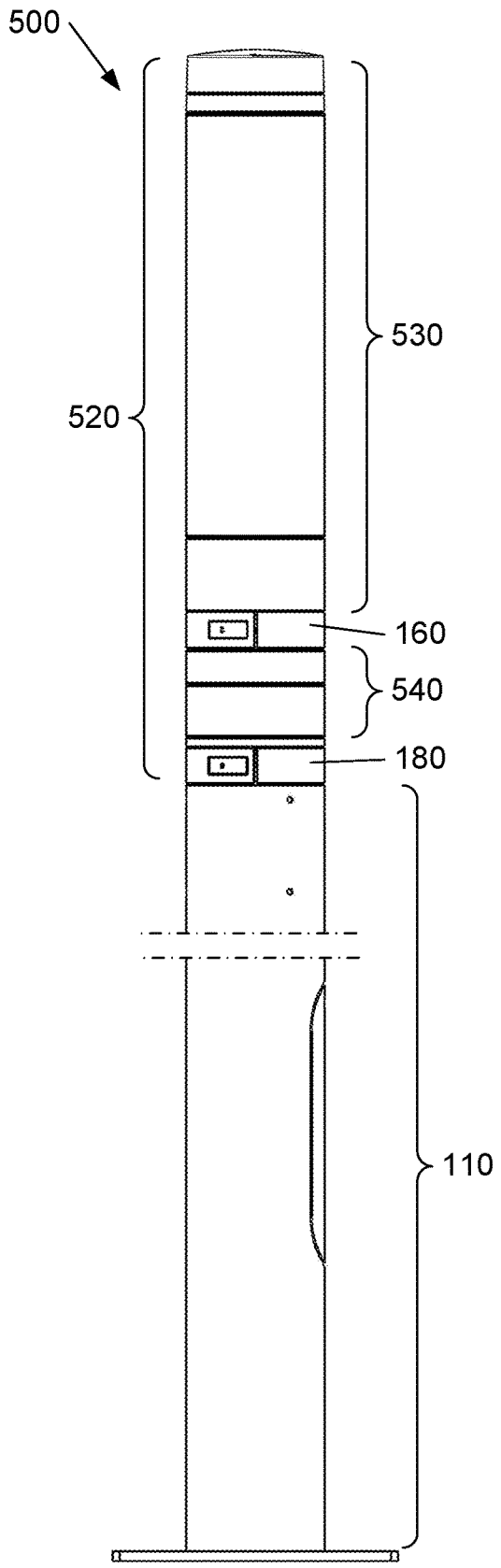

FIGS. 4 and 5 illustrate other arrangements of modular luminaires in which the modules are arranged in a different order. In FIG. 4, a modular luminaire assembly 400 is shown which comprises a supporting pole 110, as described above with reference to FIG. 1, on which is mounted a plurality of modules 420. In this embodiment, the plurality of modules comprises three modules 430, 440, 450 connected together and to the supporting pole 110 by respective module connectors 160, 170, 180 as shown. Modules 430 and 450 comprise modules whose functionality has not been previously described, and module 440 is similar to module 140 shown in FIG. 1.

Similarly, in FIG. 5, a modular luminaire assembly 500 is shown which comprises a supporting pole 110, as described above with reference to FIG. 1, on which is mounted a plurality of modules 520. In this embodiment, the plurality of modules comprises two modules 530, 550 connected together and to the supporting pole 110 by module connectors respective module connectors 160, 180. Modules 530 and 550 are similar to modules 130 and 150 as shown in FIG. 1.

Naturally, any other suitable assembly of luminaire modules is possible and is not limited to the specific examples described herein.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A luminaire comprising:

at least one lighting module including a casing and a light source and configured for providing lighting to a locality in which the luminaire is located;

at least one non-lighting module including a casing and at least one sensor unit; and at least one controller for controlling said at least one lighting module and located outside the at least one sensor unit, wherein the at least one sensor unit is operable for detecting an abnormal occurrence and generating, in response to the sensing of said abnormal occurrence, at least one event signal.

2. The luminaire according to claim 1, wherein said at least one sensor unit generates the event signal in response to the sensing of an abnormal occurrence when a sensed environmental parameter is above a predetermined threshold.

3. The luminaire according to claim 1, wherein said at least one sensor unit comprises at least one of: an air quality detector, a smoke detector, a fire detector, an acoustic detector, a seismic detector, a radiation detector, and an emergency button.

4. The luminaire according to claim 1, wherein said at least one non-lighting module further comprises a signaling unit configured for receiving at least one event control signal in accordance with a sensed abnormal occurrence and for generating at least one alarm or further comprising a third luminaire module comprising a casing and a signaling unit configured for receiving at least one event control signal in accordance with a sensed abnormal occurrence and for generating at least one alarm.

5. The luminaire according to claim 4, wherein the signaling unit comprises a multi-colored light-emitting diode ring, the colors of which are controlled in accordance with said at least one event control signal to generate an alarm.

6. The luminaire according to claim 4, wherein the signaling unit comprises a loudspeaker which is controlled by said at least one event control signal to generate an alarm.

7. The luminaire according to claim 6, wherein the loudspeaker operates as a siren to generate an alarm.

8. The luminaire according to claim 4, wherein the signaling unit comprises a display which displays information relating to the abnormal occurrence.

9. The luminaire according to claim 1, wherein said at least one event signal in accordance with a sensed abnormal occurrence is operable for adjusting the operation of said at least one lighting module.

10. The luminaire according to claim 1, wherein said at least one non-lighting module comprises at least one communication unit configured for connecting to a local area network and for transmitting signals thereto and receiving signals therefrom.

11. The luminaire according to claim 10, wherein said at least one communication unit comprises means for linking to an internet connection.

12. The luminaire according to claim 11, wherein the communication unit operates to provide an event control signal to a remote location via the internet connection in response to an event signal generated by said at least one sensor unit.

13. A luminaire network comprising a plurality of luminaires according to claim 1.

14. The luminaire network according to claim 13, further comprising an internet connection to which at least one of said plurality of luminaires is connected.

15. The luminaire network according to claim 13, further comprising a local area network to which said plurality of luminaires is connected.

16. The luminaire network according to claim 15, wherein said at least one event signal is operable for providing event control signals for at least other luminaires in the network at least over the local area network.

17. The luminaire network according to claim 14, wherein said at least one event signal provides event control signals for at least other luminaires in the network at least over the internet connection.

18. The luminaire network according to claim 17, wherein said at least one event signal provides event control signals to a remote location over the internet connection.

19. The luminaire according to claim 1, wherein the at least one sensor unit comprises an emergency button which triggers an alarm locally and/or at a remote location.

20. The luminaire according to claim 1, further comprising a supporting pole configured for supporting said at least one lighting module and said at least one non-lighting module mounted thereon, said at least one lighting module and said at least one non-lighting module forming part of the supporting pole when mounted thereon and connected to at least one of: an adjacent lighting module, an adjacent non-lighting module and the supporting pole.

21. The luminaire according to claim 1, further comprising a communication unit, and wherein the communication unit and the controller comprise a single unit.

22. A method for operating a luminaire comprising:

at least one lighting module including a casing and a light source and configured for providing lighting to a locality in which the luminaire is located;

at least one non-lighting module including a casing and at least one sensor unit; and at least one controller for controlling said at least one lighting module and located outside the at least one sensor unit, the method comprising the at least one sensor unit detecting an abnormal occurrence and generating, in response to the detecting of said abnormal occurrence, at least one event signal.

23. A system comprising:

a luminaire comprising:

at least one lighting module including a casing and a light source; and at least one controller for controlling said at least one lighting module;

a device at a remote location with respect to the luminaire, the device comprising:

a casing;

a sensor unit operable for generating an event signal in response to sensing of an abnormal occurrence; and a communication unit, wherein the communication unit is operable for providing an event control signal to the luminaire in response to the event signal generated by said at least one sensor unit.

* * * * *